United States Patent [19]

Bittel

[11] 3,966,080

[45] June 29, 1976

[54] END CLOSURE WITH RESEALABLE TAB

[75] Inventor: Patricia A. Bittel, Bay Village, Ohio

[73] Assignee: Weatherchem Corporation, Twinsburg, Ohio

[22] Filed: May 15, 1975

[21] Appl. No.: 577,737

[52] U.S. Cl. ..... 220/269; 220/307; 220/334; 222/541; 222/565; 222/556

[51] Int. Cl.[2] ..... B65D 41/32

[58] Field of Search ..... 220/269, 334, 307; 229/7 R; 222/541, 565, 556

[56] References Cited

UNITED STATES PATENTS 3,675,812 7/1972 Foster ..... 222/565 X 3,744,662 7/1973 Zundel ..... 220/269

*Primary Examiner*—George T. Hall

*Attorney, Agent, or Firm*—McNenny, Pearne, Gordon, Gail, Dickinson & Schiller

[57] ABSTRACT

A dispensing container is disclosed which includes a fiber tube, a metal top plate having an opening, and a plastic end closure received within the opening. The plastic end closure includes a stationary base and a movable tab, and the tab is movable relative to the base between an initially closed position and an open position and a sealed reclosed position.

8 Claims, 8 Drawing Figures

Fig. 1
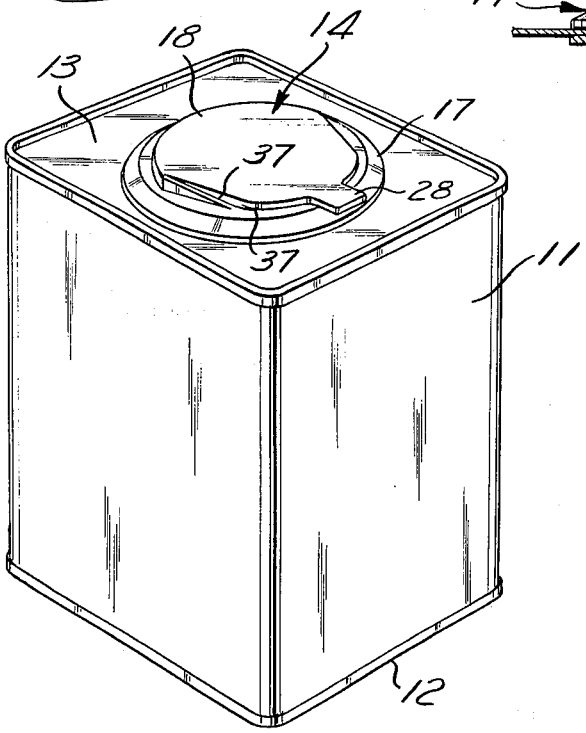
Fig. 2
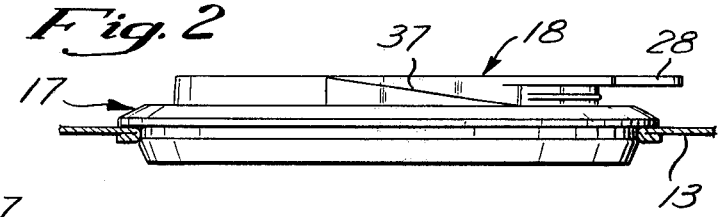
Fig. 3
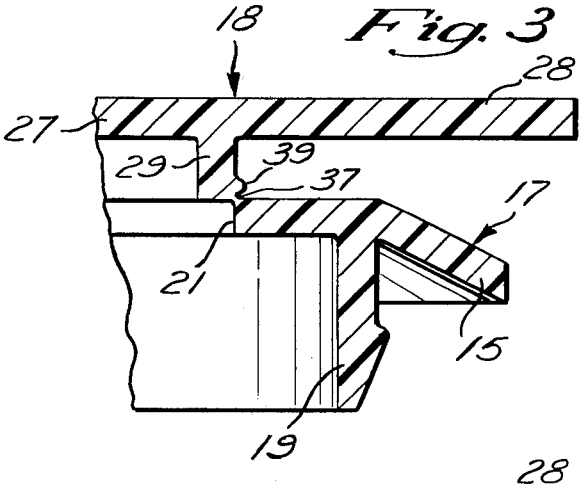
Fig. 1a
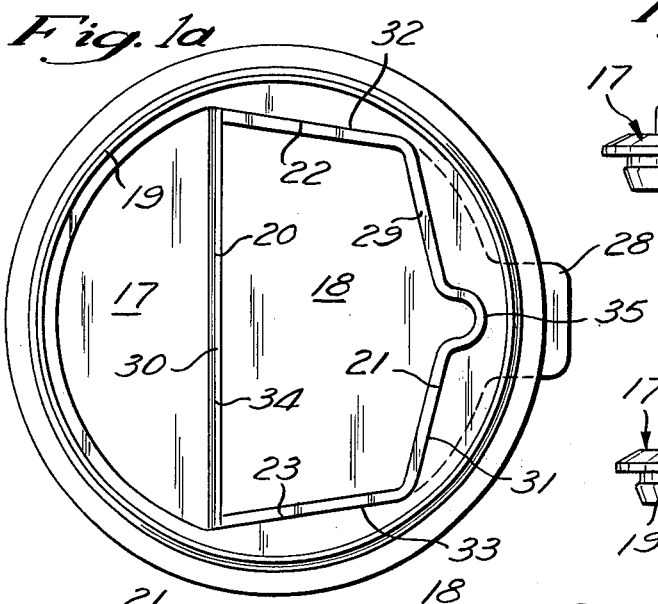
Fig. 4
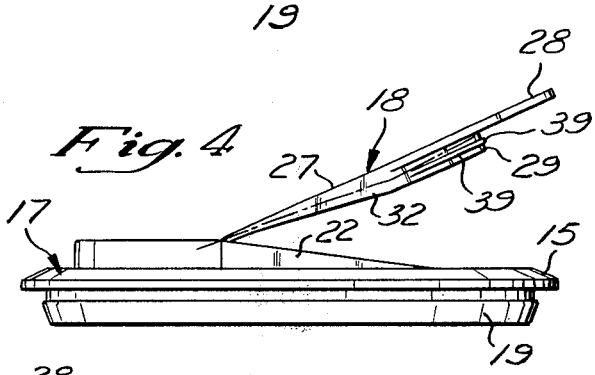
Fig. 6
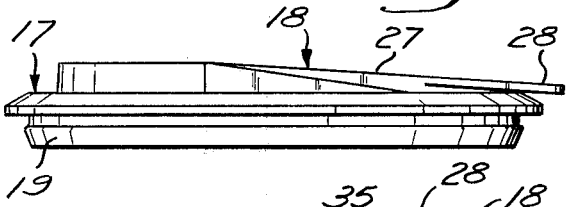
Fig. 5
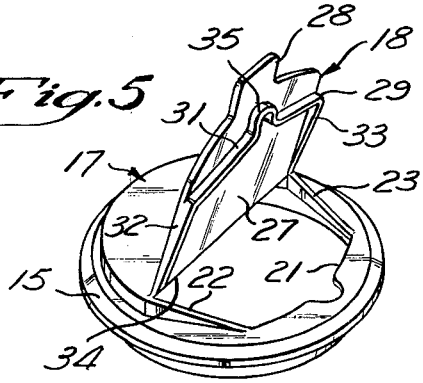
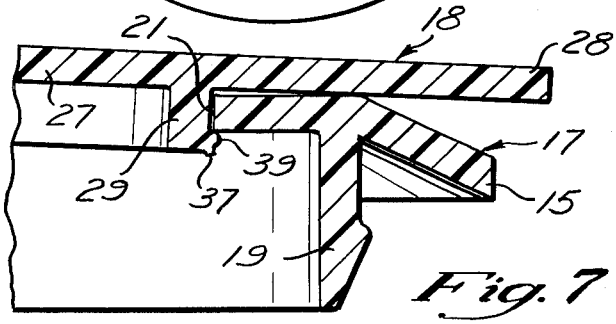
Fig. 7

END CLOSURE WITH RESEALABLE TAB

BACKGROUND AND SUMMARY OF THE INVENTION

This invention relates generally to plastic end closures, and more particularly to plastic end closures which are molded in a closed position.

Paper fiber tubes (that is, tubes which include layers of fiber material wound such as in a helix one upon the other and secured together by an adhesive) have become widely used for dispensing containers in the food packaging industry. The paper of such tubes may be plain or it may be coated, waxed, resin impregnated, or combined with other foils or films to provide a satisfactory container for various types of food products. The tubes are cut to the desired length of the container, and each end of the tube is closed.

A variety of structures are used for closing the ends of the fiber tube. One arrangement provides a metal plate which is seamed to the fiber tube. The metal plate at the top of the fiber tube includes an opening which is closed by a suitable metal plug or by a plastic end closure. Various types of plastic end closures which could be arranged to close the opening in the metal end plate are disclosed in U.S. Pat. Nos. 3,334,797, 3,338,445, and 3,659,756.

The present invention departs from these and other prior art plastic end closures by providing an end closure which is molded in a closed position and which can be repeatedly resealed after opening. The plastic end closure includes a stationary base and a movable tab, and the stationary base includes an opening defined by a peripheral edge for dispensing the contents of the container. The tab is coextensive with the opening, and the tab is movable relative to the base between an initially closed position and an open position and a reclosed position.

The tab is characterized by a generally flat top portion and a skirt portion depending axially from the top portion. The skirt portion of the tab is connected to the base along its front and sides by a reduced thickness tearing web when the tab is in its initially closed position. The tearing web is constructed and arranged to break to permit movement of the tab from the initially closed position to its open position for dispensing the contents of the container. When the tab is thereafter moved to a reclosed position, the skirt portion of the tab is frictionally received within the peripheral edge of the opening to reseal the end closure.

BRIEF DESCRIPTION OF THE DRAWINGS

These and other aspects and advantages of the invention will become readily apparent to those skilled in the art upon an understanding of the preferred embodiment of the invention shown in the accompanying drawings, wherein:

FIG. 1 is a perspective view of a dispensing container according to the principles of the invention;

FIG. 1*a* is a bottom plan view of a plastic end closure for a metal top plate of the dispensing container shown in FIG. 1 with a tab of the end closure in an initially closed position;

FIG. 2 is a side elevational view of the end closure with the tab in its initially closed position;

FIG. 3 is an enlarged fragmentary cross-sectional view of a portion of the end closure with the tab in its initially closed position;

FIG. 4 is a side elevational view of the end closure with the tab in an open position;

FIG. 5 is a perspective view of the end closure with the tab in its open position;

FIG. 6 is a side elevational view of the end closure with the tab in a reclosed position; and FIG. 7 is an enlarged fragmentary cross-sectional view of a portion of the end closure with the tab in its reclosed position.

DETAILED DESCRIPTION OF THE DRAWINGS

Referring now to the drawings in greater detail, FIG. 1 is a perspective view of a dispensing container according to the principles of the invention. The dispensing container shown in FIG. 1 is particularly adapted for use with food products and includes a fiber tube 11. The tube 11 is well-known in the art and includes layers of heavy craft paper disposed in a helix one upon the other and secured together by an adhesive. The dispensing container shown in FIG. 1 also includes a metal bottom plate 12 and a metal top plate 13 which are secured on the ends of the fiber tube 11 in a well-known manner by a seaming operation. A plastic end closure 14 is secured in an opening in the top plate 13 by a friction fit for opening and closing the container.

The plastic end closure 14 is a one-piece integral injection molded product preferably made of a relatively soft polypropylene but alternatively made of polyethylene or any other suitable common polyolefin which may readily be selected by those skilled in the art. The end closure 14 is molded in an initially closed position shown in FIGS. 1, 1*a*, 2 and 3. In this initially closed position, the end closure 14 is completely sealed to prevent escape or contamination of the contents of the container.

The one-piece end closure 14 includes a stationary base 17 and a movable tab 18 (FIGS. 2 and 3). The stationary base 17 includes a cylindrical portion 19 which is received within the metal top plate 13 and a radially outwardly extending conical flange 15 which engages the metal top plate 13 to limit the travel of the end closure 14 into the metal top plate 13 during assembly. As best seen in FIGS. 1*a* and 5, the base 17 also includes an opening for dispensing the contents of the container. The opening is defined by a peripheral edge having a back edge 20, a front edge 21, and side edges 22 and 23.

The movable tab 18 includes a generally flat top portion 27 (FIGS. 3 and 5) which extends laterally substantially coextensively with the opening in the base 17 when the tab 18 is in its initially closed position. The top portion 27 also includes a gripping area 28 which extends laterally forwardly beyond the opening in the base 17 for being grasped by a human hand to open and close the tab 18. The tab 18 also includes a skirt portion 29 depending axially downwardly from the top portion 27. The skirt portion 29 includes a front wall 31 and side walls 32 and 33 respectively confronting the front and side peripheral edges 21, 22 and 23 of the base 17 (FIGS. 1*a* and 5). The front wall 31 includes a rounded nose portion 35 extending laterally outwardly in a direction toward the gripping area 28 for concentrating the tearing stress when the tab 18 is initially opened as explained in greater detail below. A back edge 30 FIG. 1*a*) of the tab 18 is hingedly connected to the back edge 20 of the base 17 at a reduced thickness V-shaped grooved portion 34. As best seen in FIGS. 2 and 5, the side walls 32 and 33 are of significantly greater axial extent adjacent the front wall 31 than adjacent the back edge 30. This arrangement, as discussed below, insures that the entire lateral extent of the side walls 32 and 33 is sealed against substantial leakage when the tab 18 is opened and reclosed yet provides a structure which is readily molded in its initially closed position.

As mentioned above, the end closure 14 is an integral one-piece product molded in the initially closed position shown in FIGS. 1, 1a, 2 and 3. In this initially closed position, the front and side walls 31, 32 and 33 of the tab 18 are frangibly connected to the base 17 at the location of the front and side edges 21, 22 and 23, respectively, by a reduced thickness tearing web 37. The tearing web 37 extends around the entire lateral extent of the front and side walls 31, 32 and 33 and terminates at the back edge 34 of the tab 18 to seal against leakage or contamination of the contents of the container during shipping and storage prior to initial opening. When the end closure 14 is in this initially closed position, the tearing web 37 is at the bottom outside corner of the walls 31, 32 and 33 and at the top outside corner of the edges 21, 22 and 23 (FIG. 3) and the entire axial extent of each of the walls 31, 32 and 33 is disposed on the outside of the end closure 14 (FIGS. 2 and 3).

When it is desired to initially open the end closure 14 to dispense the contents of the container, the gripping area 28 of the tab 18 is grasped between the thumb and forefinger and pulled axially upwardly away from the top plate 13. This causes initial breaking of the tearing web 37 at the point on the front wall nose portion 35 laterally farthest away from the rear edge 30 and closest to the gripping area 28. In this manner, the nose portion 35 provides a point of stress concentration in the tearing web 37 at the middle of the front wall 31 so that the initial breaking is easily accomplished at that location. As the gripping area 28 is further pulled in a direction away from the top plate 13, the tearing web 37 is progressively broken along the front wall 31 on both sides of the nose portion 35 and then along the side walls 32 and 33 until the entire tearing web 37 is broken. This moves the movable tab 18 from its molded initially closed position shown in FIGS. 1, 1*a*, 2 and 3 to an open position shown in FIGS. 4 and 5. The tab 18 can be opened in a counterclockwise direction as viewed in FIGS. 4 and 5 through 180° from its initially closed position to permit the insertion of a spoon through the opening defined by the peripheral edges 20, 21, 22 and 23 or to permit pouring from the container.

After the desired amount of the contents of the container has been dispensed, the tab 18 is moved from its open position shown in FIGS. 4 and 5 to a reclosed position shown in FIGS. 6 and 7. This is accomplished by moving the tab 18 in a clockwise direction as viewed in the drawings from the position shown in FIG. 4 to the position shown in FIGS. 5 and 6 until a detent 39 which extends laterally forwardly along the entire length of the front wall 31 snaps to the inside of the front edge 21 to lock the tab in the reclosed position. When this occurs, at least some axial extent of the skirt portion 29 along the entire lateral extent of the walls 31, 32 and 33 is received within the front and side peripheral edges 21, 22 and 23, respectively, of the opening in the base 17. In this regard, the dashed line in FIG. 4 illustrates that those portions of the skirt 29 below the dashed line are received within the peripheral front and side edges 21, 22 and 23 when the tab 18 is in its reclosed position. The walls 31, 32 and 33 and the front and side edges 21, 22 and 23 are constructed and arranged so that the portions of the skirt 29 below the dashed line shown in FIG. 4 frictionally engage the front and side edges 21, 22 and 23 when the tab 18 is in its reclosed position shown in FIGS. 5 and 6. This reseals the end closure 14 and prevents substantial leakage or contamination of the contents of the container after the container has been initially opened. In this manner, the end closure 14 can be repeatedly resealed after each use to prevent contamination or substantial leakage of the contents of the container.

What is claimed is:

1. A one-piece plastic end closure comprising a stationary base and a movable tab, said stationary base including a laterally extending opening defined in part by a peripheral edge, said tab being laterally substantially coextensive with said opening, said tab being movable relative to said stationary base between an initially closed position and an open position and reclosed position, said tab including a generally flat top portion and a skirt portion depending axially from said top portion, said skirt portion of said tab being disposed exteriorly of said peripheral edge and being connected to said stationary base at the location of said peripheral edge by a reduced thickness tearing web when said tab is in said initially closed position, said tearing web being constructed and arranged to break to permit movement of said tab from said initially closed position to said open position, said tab being disposed away from said opening when said tab is in said open position, said skirt portion of said tab being received within said peripheral edge of said stationary base when said tab is in said reclosed position, said skirt portion including a lowermost outside corner and said peripheral edge including an uppermost outside corner, and said reduced thickness tearing web being located at said lowermost corner of said skirt portion and at said uppermost corner of said peripheral edge.

2. A one-piece plastic end closure as defined in claim 1 wherein said skirt portion of said tab frictionally engages said peripheral edge of said stationary base substantially along the entire lateral extent of said skirt portion when said tab is in said reclosed position.

3. A one-piece plastic end closure as defined in claim 1 wherein said stationary base includes another peripheral edge cooperating with said first mentioned peripheral edge to completely define said opening, and said tab is hingedly connected to said other peripheral edge for rotational movement about said hinged connection between said initially closed position and said open position and said reclosed position.

4. A one-piece plastic end closure as defined in claim 1 wherein said peripheral edge is of predetermined shape, and said skirt portion is of similar shape to said predetermined shape of said peripheral edge.

5. A one-piece plastic end closure comprising a stationary base and a movable tab, said stationary base including a laterally extending opening defined by front and back and side peripheral edges, said tab being laterally substantially coextensive with said opening, said tab being movable relative to said stationary base between an initially closed position and an open position and a reclosed position, said tab including a generally flat top portion and a skirt portion depending axially from said top portion, said skirt portion including a front wall and side walls extending laterally substantially coextensively with said front and side edges respectively of said opening when said tab is in said initially closed position, said skirt portion of said tab being connected to said stationary base at the location of said front and side peripheral edges by a reduced thickness tearing web when said tab is in said initially closed position, said tearing web being constructed and arranged to break to permit movement of said tab from said initially closed position to said open position, said tab being disposed away from said opening when said tab is in said open position, at least some axial extent of the entire lateral extent of said front and side walls of said skirt portion being received within said peripheral edge of said stationary base when said tab is in said reclosed position, said tab including a back edge, said back edge of said tab being hingedly connected to said back edge of said opening when said tab is in each of said positions, said side walls extending between said front wall and said back edge of said tab, and the axial extent of said side walls adjacent said front wall being substantially greater than the axial extent of said side walls adjacent said back edge of said tab.

6. A one-piece plastic end closure as defined in claim 5 wherein said top portion of said tab includes a gripping area, and said gripping area is adjacent said front wall of said skirt portion.

7. A one-piece plastic end closure as defined in claim 6 wherein said front wall includes a curved nose portion projecting laterally outwardly toward said gripping area, said curved nose portion is disposed in the middle of said front wall, and said curved nose portion provides an area of stress concentration for the breaking of said tearing web.

8. A one-piece plastic end closure as defined in claim 6 wherein said front and side walls of said skirt portion are disposed exteriorly of said front and side peripheral edges of said stationary base when said tab is in said initially closed position.

* * * * *